US012196219B1

(12) United States Patent
Liu

(10) Patent No.: US 12,196,219 B1
(45) Date of Patent: Jan. 14, 2025

(54) MOTOR AND BLADE MOUNTING STRUCTURE OF CEILING FAN

(71) Applicant: AIR COOL INDUSTRIAL CO., LTD., Taichung (TW)

(72) Inventor: Tim Liu, Taichung (TW)

(73) Assignee: AIR COOL INDUSTRIAL CO., LTD., Taichung (TW)

( * ) Notice: Subject to any disclaimer, the term of this patent is extended or adjusted under 35 U.S.C. 154(b) by 0 days.

(21) Appl. No.: 18/403,775

(22) Filed: Jan. 4, 2024

(51) Int. Cl.
*F04D 29/34* (2006.01)
*F04D 19/00* (2006.01)
*F04D 25/08* (2006.01)

(52) U.S. Cl.
CPC ..... *F04D 29/34* (2013.01); *F04D 19/002* (2013.01); *F04D 25/088* (2013.01)

(58) Field of Classification Search
CPC ..... F04D 25/088; F04D 29/34
See application file for complete search history.

(56) References Cited

U.S. PATENT DOCUMENTS 5,899,663 A * 5/1999 Feder ..... F04D 29/34 416/5
6,352,411 B1 * 3/2002 Bucher ..... F04D 29/34 403/302
6,821,091 B2 * 11/2004 Lee ..... F04D 29/34 416/207

* cited by examiner

*Primary Examiner* — Courtney D Heinle
*Assistant Examiner* — John S Hunter, Jr.
(74) *Attorney, Agent, or Firm* — Ying-Ting Chen

(57) ABSTRACT

A motor and blade mounting structure of a ceiling fan, the ceiling fan has a motor, at least one bracket, and at least one blade. The at least one bracket has at least one mounting portion. The mounting portion of the at least one bracket is configured for mounting the at least one blade. The motor has a rotor. The rotor of the motor is fixedly connected to the at least one bracket. The motor and blade mounting structure enhances assembly convenience, safety, structural support and durability.

1 Claim, 8 Drawing Sheets

MOTOR AND BLADE MOUNTING STRUCTURE OF CEILING FAN

FIELD OF THE INVENTION

The present invention relates to a ceiling fan, and more particularly, to a motor and blade mounting structure of a ceiling fan.

BACKGROUND OF THE INVENTION

In general, conventional ceiling fans are fixedly connected to the ceiling. Most ceiling fans are designed with a variety of mounting structures to allow for easy installation high above the floor.

A common blade mounting structure includes a plurality protruding posts, a plurality of locking structures and an elastic holding member on a ceiling fan blade bracket and blades. For installation, the protruding posts are locked to the locking structures, and the elastic holding member is configured to hold the protruding posts to complete the assembly of the blades.

When the ceiling fan runs for a long period of time, it will bring continuous vibration and rotation, leading to wear and tear of the locking structures and the protruding posts and instability of the blades. In addition, the elastic holding member is more likely to lose its holding function because of elastic fatigue, causing danger to the user. Accordingly, the inventor of the present invention has devoted himself based on his many years of practical experiences to solve these problems.

SUMMARY OF THE INVENTION

The primary object of the present invention is to provide a motor and blade mounting structure of a ceiling fan, which has the effects of enhancing assembly convenience, safety, structural support and durability.

In order to achieve the above object, a motor and blade mounting structure of a ceiling fan is provided. The ceiling fan has a motor, at least one bracket, and at least one blade. The at least one bracket has at least one mounting portion. The mounting portion of the at least one bracket is configured for mounting the at least one blade. The motor has a rotor. The rotor of the motor is fixedly connected to the at least one bracket. The mounting portion has a plurality of positioning holes, a plurality of locking holes, and a first hole. The positioning holes, the locking holes and the first hole pass through the at least one bracket. Each positioning hole communicates with a corresponding one of the locking holes. The locking holes are located at outer sides of the positioning holes, respectively. The blade includes a blade body, a plurality of protruding posts, a plurality of elastic washers, a second hole, two third holes, a plate, and a fixing member. One side of the blade body is longitudinally formed with the protruding posts, the second hole and the third holes. The plate is located on one side of the blade body, facing away from the at least one bracket. The plate has a fourth hole corresponding to the first hole, the second hole and the fixing member. One side of each protruding post is fixedly connected to the plate. Another side of each protruding post passes through a corresponding one of the third holes and extends toward the at least one bracket to form a longitudinal post body. One end of the post body, adjacent to the at least one bracket, extends laterally and outwardly to form a head portion. The head portion has a diameter greater that of the post body. The elastic washers each have a body portion. The body portions of the elastic washers are sleeved on the post bodies of the protruding posts, respectively. One side of the body portion of each elastic washer, adjacent to the head portion of the corresponding protruding post, extends laterally and outwardly to form an elastic spacer ring. The head portions of the protruding posts and the elastic washers correspond to the positioning holes, respectively. The post bodies of the protruding posts and the body portions of the elastic washers correspond to the locking holes, respectively.

When the blade is to be mounted, the head portions of the protruding posts and the elastic washers pass through the respective locating holes, and the post bodies of the protruding posts and the body portions of the elastic washers are displaced and locked in the respective locking holes. When the protruding posts are locked in the respective locking holes, the body portions of the elastic washers are located between the respective protruding posts and the at least one bracket. The elastic spacer rings of the elastic washers are located between the head portions of the respective protruding posts and the at least one bracket. The blade body, the head portions of the protruding posts and the elastic spacer rings of the elastic washers are locked on two sides of the at least one bracket. The fixing member is inserted from one side of the blade, facing away from the at least one bracket, to pass through the first hole, the second hole and the fourth hole for fixing the blade body and the plate to the at least one bracket.

DETAILED DESCRIPTION OF THE PREFERRED EMBODIMENTS

Figure 1:
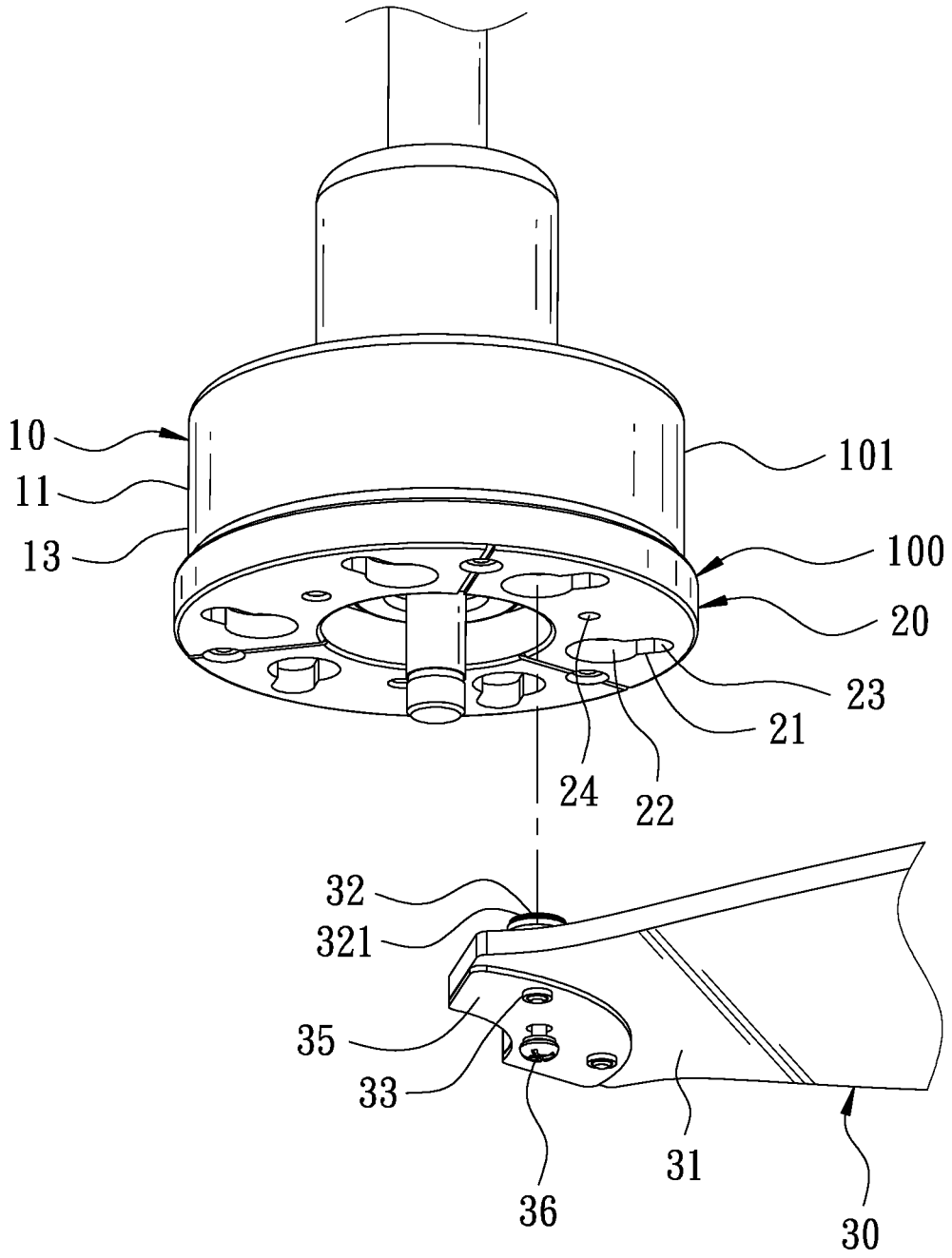
FIG. 1 is an exploded view of a first embodiment of the present invention.
Figure 2:
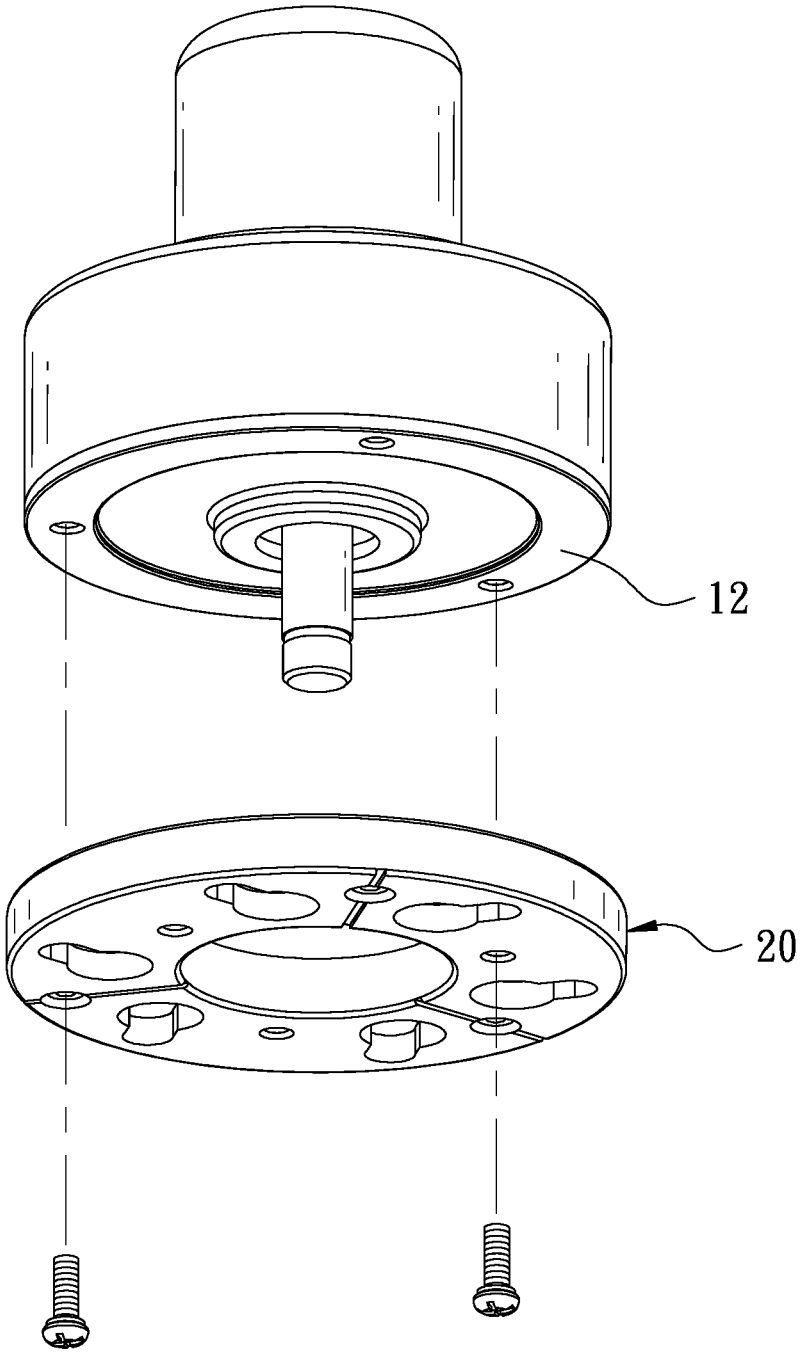
FIG. 2 is a partial exploded view of the first embodiment of the present invention.
Figure 3:
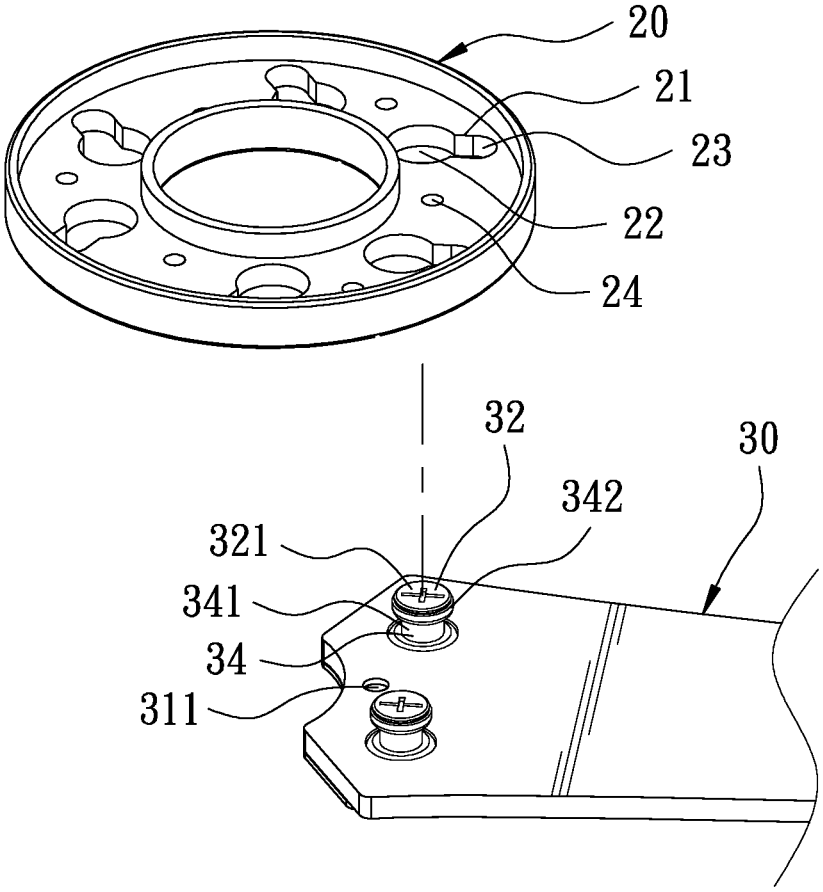
FIG. 3 is another partial exploded view of the first embodiment of the present invention.
Figure 4:
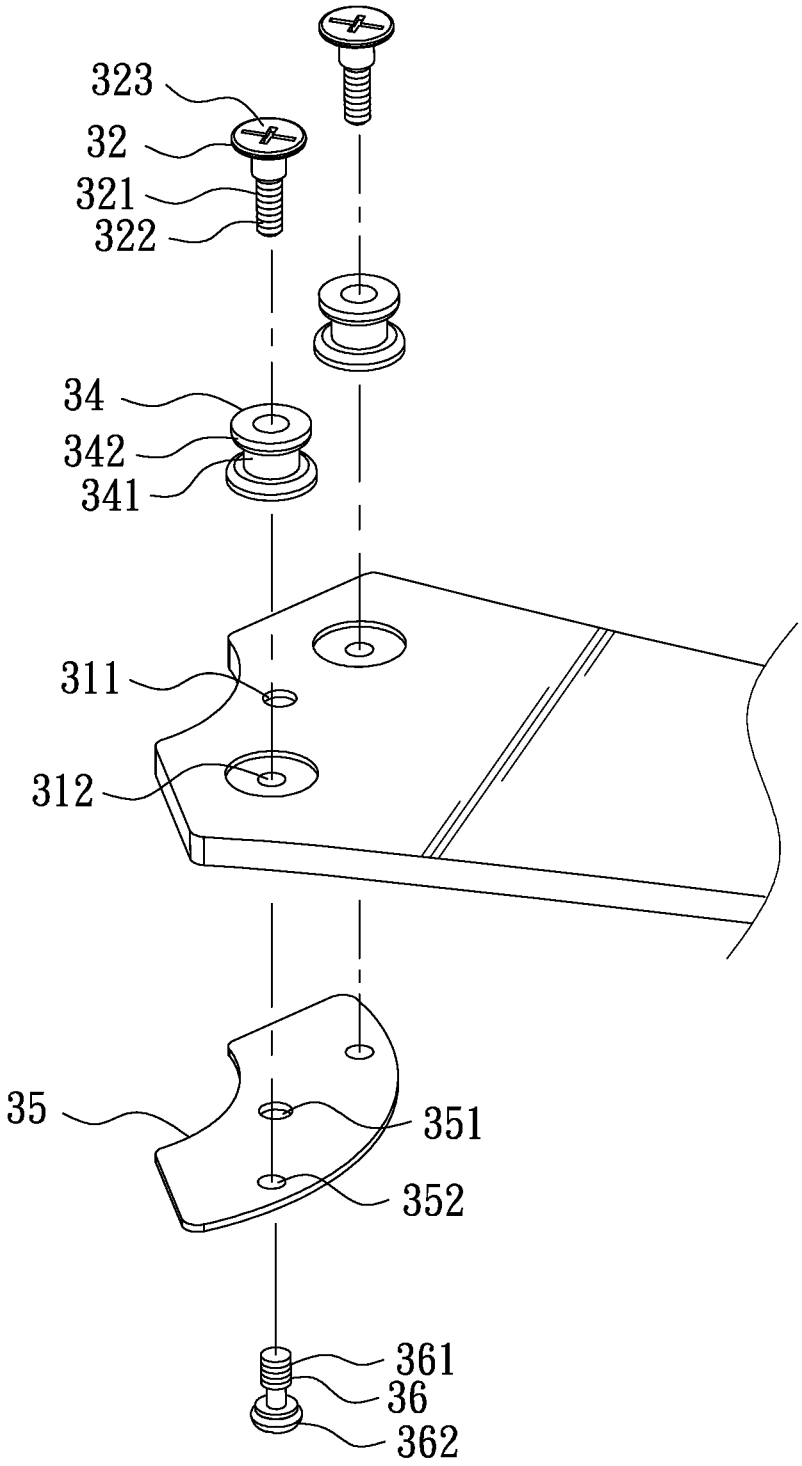
FIG. 4 is a further partial exploded view of the first embodiment of the present invention.

Embodiments of the present invention will now be described, by way of example only, with reference to the accompanying drawings.

As shown in FIG. 1 through FIG. 7, the present invention discloses a motor and blade mounting structure 100 of a ceiling fan 101. The ceiling fan 101 comprises a motor 10, at least one bracket 20, and at least one blade 30.

The motor 10 has a housing 11 and a rotor 12. The housing 11 includes an outer cover 13. The rotor 12 is disposed in the housing 11 and the outer cover 13.

The at least one bracket 20 has at least one mounting portion 21. The rotor 12 of the motor 10 is fixedly connected to the at least one bracket 20. The mounting portion 21 has a plurality of positioning holes 22, a plurality of locking holes 23, and a first hole 24. The positioning holes 22, the locking holes 23 and the first hole 24 pass through the at least one bracket 20. Each positioning hole 22 communicates with a corresponding one of the locking holes 23. The locking holes 23 are located at the outer sides of the positioning holes 22, respectively. The first hole 24 is a screw hole. The at least one bracket 20 and the outer cover 13 form the housing 11. The at least one bracket 20 is made of metal.

The mounting portion 21 of the at least one bracket 20 is configured for mounting the at least one blade 30. The blade 30 includes a blade body 31, a plurality of second screws 32, a plurality of nuts 33, a plurality of protruding posts 321, a plurality of elastic washers 34, a second hole 311, two third holes 312, a plate 35, and a fixing member 36. The second screws 32 are formed with the protruding posts 321, respectively. One side of the blade body 31 is longitudinally formed with the protruding posts 321, the second hole 311 and the third holes 312. The plate 35 is located on one side of the blade body 31, facing away from the at least one bracket 20. The plate 35 has a fourth hole 351 corresponding to the first hole 24, the second hole 311 and the fixing member 36. One side of each protruding post 321 is fixedly connected to the plate 35. The other side of each protruding post 321 passes through a corresponding one of the third holes 312 and extends toward the at least one bracket 20 to form a longitudinal post body 322. One end of the post body 322, adjacent to the at least one bracket 20, extends laterally and outwardly to form a head portion 323. The diameter of the head portion 323 is greater than the diameter of the post body 322. The elastic washers 34 each have a body portion 341. The body portions 41 of the elastic washers 34 are sleeved on the post bodies 322 of the protruding posts 321, respectively. One side of the body portion 341 of each elastic washer 34, adjacent to the head portion 323 of the corresponding protruding post 321, extends laterally and outwardly to form an elastic spacer ring 42. The head portions 323 of the protruding posts 321 and the elastic washers 34 correspond to the positioning holes 22, respectively. The post bodies 322 of the protruding posts 321 and the body portions 341 of the elastic washers 34 correspond to the locking holes 23, respectively. The diameter of each positioning hole 22 is greater than the diameter of the head portion 323 of each protruding post 321 and greater than the diameter of the elastic spacer ring 342. The diameter of each locking hole 23 is less than the diameter of the head portion 323 of each protruding portion 321 and less than the diameter of the elastic spacer ring 342. The plate 35 has a plurality of fifth holes 352 corresponding to the second screws 32. The fifth holes 352 are configured for insertion of the second screws 32. The plate 35 is made of metal. The second screws 32 pass through the fifth holes 352 and are locked by the nuts 33 on one side of the plate 35, facing away from the at least one bracket 20.

Figure 5:
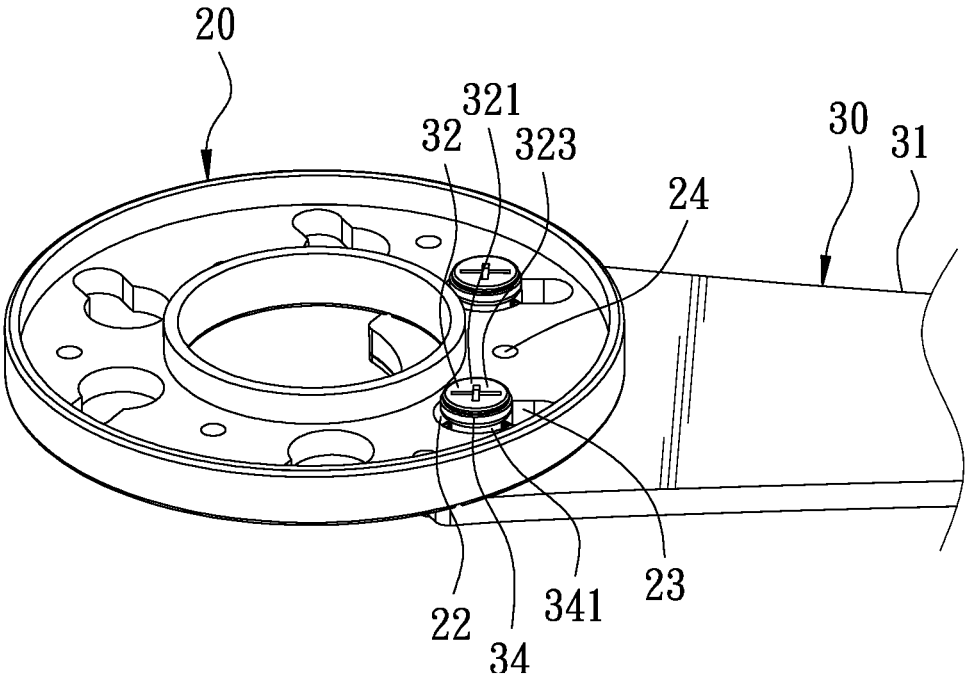
FIG. 5 is a schematic view of the first embodiment of the present invention when in use, wherein the protruding posts are positioned in the positioning holes.
Figure 6:
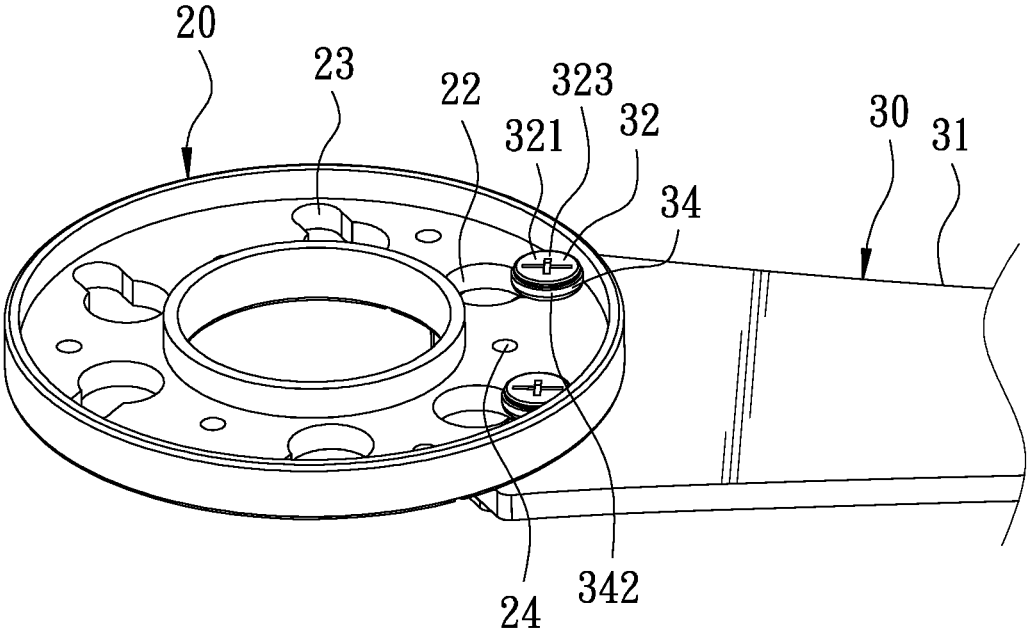
FIG. 6 is a schematic view of the first embodiment of the present invention when in use, wherein the protruding posts are locked in the locking holes.
Figure 7:
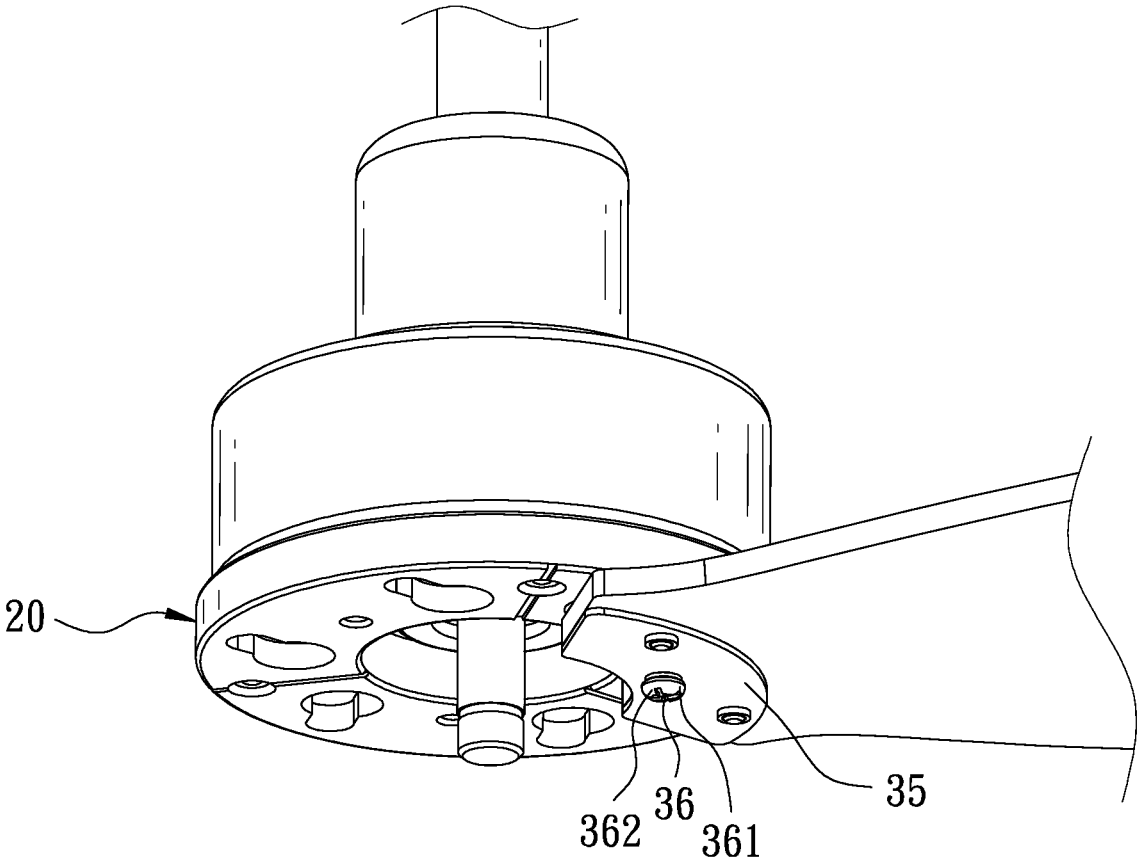
FIG. 7 is a schematic view of the first embodiment of the present invention when in use, wherein the fan body is mounted to the bracket.

Referring to FIG. 5, when the blade 30 is to be mounted, the head portions 323 of the protruding posts 321 and the elastic washers 34 pass through the respective locating holes 22, and the post bodies 322 of the protruding posts 321 and the body portions 341 of the elastic washers 34 are displaced and locked in the respective locking holes 23. As shown in FIG. 6, when the protruding posts 321 are locked in the respective locking holes 23, the body portions 341 of the elastic washers 34 are located between the respective protruding posts 321 and the at least one bracket 20, and the elastic spacer rings 342 of the elastic washers 34 are located between the head portions 323 of the respective protruding posts 321 and the at least one bracket 20, thereby reducing the wear of the at least one bracket 20, the locking holes 23 and the protruding posts 321 greatly. The blade body 31, the head portions 323 of the protruding posts 321 and the elastic spacer rings 342 of the elastic washers 34 are locked on both sides of the at least one bracket 20. The plate 35 and the at least one bracket 20 are made of metal, which further increases safety, structural support and durability. Finally, the fixing member 36 is inserted from one side of the blade 30, facing away from the at least one bracket 20, to pass through the first hole 24, the second hole 311 and the fourth hole 351 for fixing the blade body 31 and the plate 35 to the at least one bracket 20. The fixing member 36 is a first screw 361. The first screw 361 has a screw head 362. When the first screw 361 is locked, the screw head 362 is located on one side of the plate 35, facing away from the at least one bracket 20, as shown in FIG. 7, which also improves assembly convenience.

Figure 8:
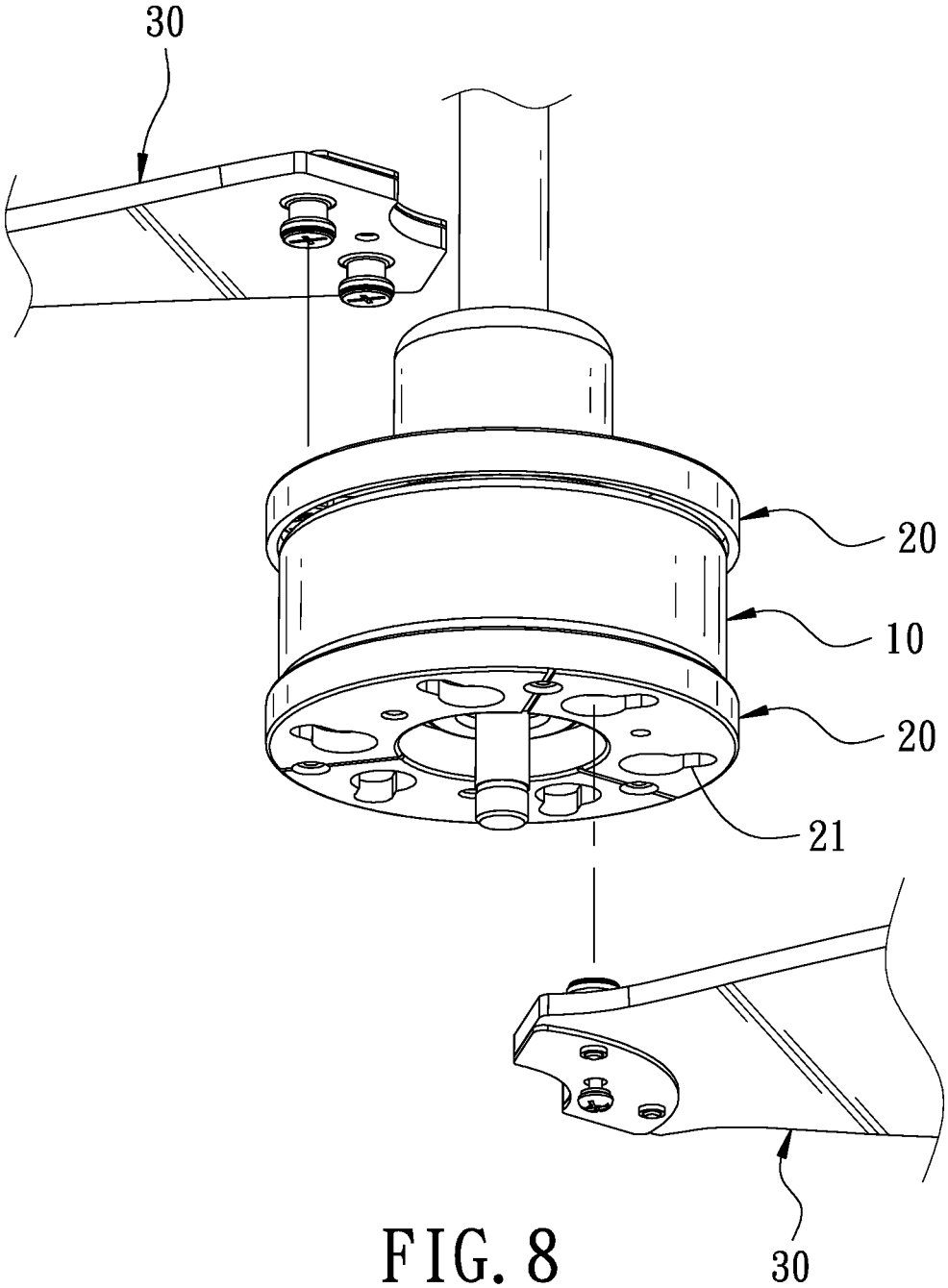
FIG. 8 is a schematic view of a second embodiment of the present invention when in use, illustrating two brackets.

FIG. 8 is a schematic view of a second embodiment of the present invention when in use. The at least one bracket 20 includes two brackets 20 disposed the upper and lower sides of the motor 10. The at least one mounting portion 21 is plural. The at least one blade 30 is plural. The mounting portions 21 are configured for mounting the blades 30, respectively. This increases changes in the mounting position of the blades 30 and the air volume and direction of the airflow generated by the blades 30.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A motor and blade mounting structure of a ceiling fan, the ceiling fan having a motor, at least one bracket and at least one blade, the at least one bracket having at least one mounting portion, the mounting portion of the at least one bracket being configured for mounting the at least one blade, the motor having a rotor, the rotor of the motor being fixedly connected to the at least one bracket;

the mounting portion having a plurality of positioning holes, a plurality of locking holes and a first hole, the positioning holes, the locking holes and the first hole passing through the at least one bracket, each positioning hole communicating with a corresponding one of the locking holes, the locking holes being located at outer sides of the positioning holes, respectively;

the blade including a blade body, a plurality of protruding posts, a plurality of elastic washers, a second hole, a plurality of third holes, a plate and a fixing member, one side of the blade body being longitudinally formed with the protruding posts, the second hole and the third holes, the plate being located on one side of the blade body, facing away from the at least one bracket, the plate having a fourth hole corresponding to the first hole, the second hole and the fixing member, one side of each protruding post being fixedly connected to the plate, another side of each protruding post passing through a corresponding one of the third holes and extending toward the at least one bracket to form a longitudinal post body, one end of the post body, adjacent to the at least one bracket, extending laterally and outwardly to form a head portion, the head portion having a diameter greater that of the post body, the elastic washers each having a body portion, the body portions of the elastic washers being sleeved on the post bodies of the protruding posts respectively, one side of the body portion of each elastic washer, adjacent to the head portion of the corresponding protruding post, extending laterally and outwardly to form an elastic spacer ring, the head portions of the protruding posts and the elastic washers corresponding to the positioning holes respectively, the post bodies of the protruding posts and the body portions of the elastic washers corresponding to the locking holes, respectively;

wherein when the blade is to be mounted, the head portions of the protruding posts and the elastic washers pass through the respective locating holes, and the post bodies of the protruding posts and the body portions of the elastic washers are displaced and locked in the respective locking holes; when the protruding posts are locked in the respective locking holes, the body portions of the elastic washers are located between the respective protruding posts and the at least one bracket, and the elastic spacer rings of the elastic washers are located between the head portions of the respective protruding posts and the at least one bracket, the blade body, the head portions of the protruding posts and the elastic spacer rings of the elastic washers are locked on two sides of the at least one bracket, wherein the blade body and plate are fixed to the at least one bracket by inserting the fixing member from one side of the blade, facing away from the least one bracket and passing through the first hole, the second hole and fourth hole;

wherein each positioning hole has a diameter greater than that of the head portion of each protruding post and greater than that of the elastic spacer ring, and each locking hole has a diameter less than that of the head portion of each protruding portion and less than that of the elastic spacer ring;

wherein the fixing member is a first screw, the first screw has a screw head, the first hole is a screw hole, when the first screw is locked, the screw head is located on one side of the plate, facing away from the at least one bracket, the blade further includes a plurality of second screws, the second screws are formed with the protruding posts respectively, the plate has a plurality of fifth holes corresponding to the second screws, and the fifth holes are configured for insertion of the second screws;

wherein the plate is made of metal;

wherein the blade further includes a plurality of nuts, and the second screws pass through the fifth holes and are locked by the nuts on the side of the plate, facing away from the at least one bracket;

wherein the motor further includes a housing, the housing includes an outer cover, the rotor is disposed in the housing and the outer cover, and the at least one bracket and the outer cover form the housing;

wherein the at least one bracket is made of metal;

wherein the at least one bracket includes two brackets disposed upper and lower sides of the motor, the at least one mounting portion is plural, the at least one blade is plural, and the mounting portions are configured for mounting the blades, respectively.

* * * * *